US011350682B2

(12) United States Patent
Taylor et al.

(10) Patent No.: US 11,350,682 B2
(45) Date of Patent: Jun. 7, 2022

(54) CONFORMABLE AND EXPANDABLE PROTECTIVE CUSHIONING PADS AND ARTICLES OF APPAREL INCLUDING SUCH PADS

(71) Applicant: G-FORM LLC, Providence, RI (US)

(72) Inventors: Brant Michael Taylor, Providence, RI (US); Michael Newton, Providence, RI (US); Nicholas H. Dupree, Providence, RI (US); James E. Gaudet, Providence, RI (US)

(73) Assignee: G-FORM LLC, Providence, RI (US)

( * ) Notice: Subject to any disclaimer, the term of this patent is extended or adjusted under 35 U.S.C. 154(b) by 75 days.

(21) Appl. No.: 16/569,149

(22) Filed: Sep. 12, 2019

(65) Prior Publication Data

US 2021/0076758 A1 Mar. 18, 2021

(51) Int. Cl.

| | |
|---|---|
| ***A41D 13/05*** | (2006.01) |
| ***A41D 13/015*** | (2006.01) |
| ***A42B 1/08*** | (2006.01) |
| ***A41D 13/08*** | (2006.01) |
| ***A41D 31/28*** | (2019.01) |

(52) U.S. Cl.

CPC ..... *A41D 13/015* (2013.01); *A41D 13/0543* (2013.01); *A41D 13/08* (2013.01); *A41D 31/285* (2019.02); *A42B 1/08* (2013.01)

(58) Field of Classification Search

CPC .. A42B 1/08; A42B 3/12; A42B 3/121; A41D 13/015; A41D 31/28; A41D 31/285; A41D 13/05; A41D 13/0531; A41D 13/0543; A41D 13/06; A41D 13/365; A41D 13/051; A41D 13/087

USPC ..... 2/414

See application file for complete search history.

(56) References Cited

U.S. PATENT DOCUMENTS

| | | | | |
|---|---|---|---|---|
| 4,023,213 | A * | 5/1977 | Rovani | A42B 3/121 2/413 |
| 4,354,284 | A * | 10/1982 | Gooding | A42B 3/00 2/413 |
| 4,481,679 | A * | 11/1984 | Hayes | A63B 71/12 2/463 |
| 5,168,576 | A * | 12/1992 | Krent | A41D 31/285 2/456 |

(Continued)

FOREIGN PATENT DOCUMENTS

| | | |
|---|---|---|
| EP | 3473120 A1 | 1/2013 |
| WO | 9205717 A1 | 4/1992 |

*Primary Examiner* — Katherine M Moran
*Assistant Examiner* — Haley A Smith
(74) *Attorney, Agent, or Firm* — Burns & Levinson LLP; Joseph P. Quinn

(57) ABSTRACT

A protective padding section includes an upper layer, an opposing lower layer and a repeating array of cushioning regions disposed between, and continuously bonded to, the upper layer and the lower layer. Each cushioning region has a same first cushion thickness. A repeating array of apertures is disposed between the cushioning regions and each aperture extends through the padding section. The padding section has a first thickness and a first width and upon application of a force, the padding section expands in width from the first width to a second width greater than the first width and when the application of force is removed, the width of the padding section contracts to the first width.

12 Claims, 11 Drawing Sheets

(56) References Cited

U.S. PATENT DOCUMENTS

| | | | | |
|---|---|---|---|---|
| 6,202,217 | B1 * | 3/2001 | Karall | A41D 31/28 2/161.6 |
| 7,827,704 | B2 * | 11/2010 | Fox | B29D 35/142 36/44 |
| 8,084,117 | B2 * | 12/2011 | Lalvani | B32B 5/18 428/136 |
| 9,254,591 | B2 * | 2/2016 | Fox | B32B 27/304 |
| 9,538,798 | B2 | 1/2017 | Toronjo | |
| 9,554,624 | B2 | 1/2017 | Cross | |
| 9,615,611 | B2 * | 4/2017 | Wyner | B32B 27/12 |
| 9,629,397 | B2 | 4/2017 | Toronjo | |
| 9,730,490 | B2 | 8/2017 | Farris et al. | |
| 2007/0113317 | A1 * | 5/2007 | Garneau | A63B 71/14 2/161.1 |
| 2008/0034614 | A1 | 2/2008 | Fox et al. | |
| 2009/0255625 | A1 * | 10/2009 | Fox | B29D 35/148 156/247 |
| 2014/0101816 | A1 * | 4/2014 | Toronjo | A45F 3/12 2/69 |
| 2014/0109286 | A1 * | 4/2014 | Blakely | A41D 31/04 2/69 |
| 2015/0082523 | A1 * | 3/2015 | Wyner | B32B 3/04 2/455 |
| 2017/0100660 | A1 * | 4/2017 | Campbell | A42B 3/00 |
| 2018/0325216 | A1 * | 11/2018 | Toronjo | A43B 23/0255 |

* cited by examiner

CONFORMABLE AND EXPANDABLE PROTECTIVE CUSHIONING PADS AND ARTICLES OF APPAREL INCLUDING SUCH PADS

TECHNICAL FIELD

The present disclosure is directed to conformable and expandable protective cushioning pads, to items comprising the pads, and to methods of making and using the foregoing.

BACKGROUND

Many garments and other articles of apparel are designed to fit closely to the human body. When designing an article of protective apparel for a close fit to the human body, however, different body shapes and sizes must be considered. Different individuals within a particular garment size will have different body shapes and sizes. For example, two individuals wearing the same shoe size may have very differently shaped heels. As another example, two individuals wearing the same shirt size may have very different chest to abdomen dimensions. These variable measurements between similarly sized individuals makes proper design of closely fitting garments difficult.

In addition to accounting for different body measurements for different individuals within a size, various contours of the human body must also be considered when designing closely fitting protective articles of apparel. These contours of the human body often include various double curvature surfaces. Spheroids, bowls, and saddle-backs are all examples of surfaces having double curvatures. If a protective garment is not properly sized for a particular wearer, the wearer may experience undesirable tightness or looseness at various locations. Such an improper fit may result in discomfort, excessive wear, or bending or creasing of the garment at the poorly fitting locations each of which can diminish the protective features of the garment.

Design Blue Limited of Portslade Brighton and Hove, United Kingdom, makes molded padding from a proprietary blend of polymer material under the brand name D3O®. One such molded piece includes a repeating array of circular and triangular pods, with molded structural members extending between and interconnecting each of the adjacent pods.

U.S. Pat. No. 8,084,117 discloses expandable sheet materials comprising arrangements of slits distributed on the surface of the sheet, which allow for expansion of the sheet material upon the application of a force along or across the surface of the sheet material.

U.S. Pat. Nos. 9,538,798 and 9,629,397 disclose articles of apparel with a base layer and an auxetic layer coupled to the base layer. The auxetic layer includes an auxetic structure that defines a pattern of repeating apertures. The auxetic structure is formed from an elastomeric polymer.

U.S. Pat. No. 9,554,624 discloses a sneaker with an auxetic sole structure formed from adjoining, hinged members surrounding apertures. Under tension, the members rotate with respect to each other in the sole structure, thereby allowing the auxetic sole structure to expand under tension.

U.S. Pat. No. 9,730,490 discloses a footwear article with an upper with openings arranged in an auxetic configuration. The openings include two sizes, such that the larger openings may expand more than the smaller openings.

In view of the foregoing, it would be desirable to provide a protective garment or other article of apparel capable of conforming to various body shapes within a given size range. It would also be desirable to provide a garment or other article of apparel that is capable of conforming to various curvatures on the human body.

SUMMARY

Disclosed herein is a padding section that includes an upper layer, an opposing lower layer and a repeating array of cushioning regions disposed between and continuously bonded to the upper layer and the lower layer, each cushioning region comprising cushioning material having a same first cushion thickness. The padding section also includes a repeating array of apertures disposed between the cushioning regions and extending through the padding. The padding section has a first thickness and a first width and wherein upon application of a force, the padding section expands in width from the first width to a second width greater than the first width and when the application of force is removed, the width of the padding section contracts to the first width.

The padding section can comprise a plurality of cushioning bridges extending between and interconnecting adjacent cushioning regions, each cushioning bridge having a bridge thickness, a bridge width and a bridge length.

The padding section can comprise the cushioning bridge thickness being less than a cushion thickness of the cushioning regions.

The padding section can comprise the bridge length being no more than ⅓ of a cushion length of the cushioning region.

The padding section can comprise the cushioning region comprising sidewalls and the bridges are spaced apart from a midline of the cushioning region sidewalls.

The padding section can comprise the cushioning regions and the bridges together defining a plurality of spacer regions.

The padding section can comprise the upper layer and the lower layer at least partially bonded directly together in each spacer region.

The padding section can comprise the cushioning bridges being disposed in the spacer regions.

The padding section can comprise the repeating pattern of apertures being disposed in the spacer regions wherein one aperture is disposed in each spacer region.

The padding section can comprise the padding section expanding in width by 20% to 30% when subjected to the force.

The padding section can comprise a perimeter flange extending around the padding section.

The padding section can comprise that when the padding section is subjected to the force, the cushioning regions pivot about the bridges and the apertures expand from a first size to a second size and when the force is removed, the apertures contract from the second size to the first size.

In another aspect of the present disclosure there is a protective pad, comprising: a substrate of cushioning material having a first surface and an opposed second surface with an upper layer of material bonded to the first surface of the substrate and a lower layer of material bonded to the second surface of the substrate; a plurality of discrete spaced apart cushioning regions provided in the substrate, each cushioning region having a same first cushion thickness; a first plurality of linear substrate apertures, each aperture disposed between adjacent cushioning regions in a first plurality of cushioning regions, each aperture extending through the cushioning material and the upper and lower layers of material and each aperture of the first plurality aligned with a first axis of the substrate; and a second plurality of linear substrate apertures, each aperture disposed between adjacent cushioning regions in a second plurality of cushioning regions, each aperture extending through the cushioning material and the upper and lower layers of material and each aperture of the second plurality aligned with a second axis of the substrate different than the first axis.

BRIEF DESCRIPTION OF THE DRAWINGS

The foregoing and other features and advantages will be apparent from the following more particular description of exemplary embodiments of the disclosure, as illustrated in the accompanying drawings, in which like reference characters refer to the same parts throughout the different views. The drawings are not necessarily to scale, emphasis instead being placed upon illustrating the principles of the disclosure.

DETAILED DESCRIPTION OF EXEMPLARY EMBODIMENTS

The present disclosure is directed to conformable and expandable protective cushioning pads, to items comprising the pads, and to methods of making and using the foregoing and, in particular, to conformable and expandable protective cushioning pads for humans, for areas of the human body that require free range of motion. In some embodiments, the present cushioning pads may have properties that are similar to auxetic materials. The term "auxetic" as used herein generally refers to a material or structure that has a negative Poisson's ratio. Auxetic materials come in various different types and forms and can be single molecules or a particular structure of macroscopic matter. Some, but not all, auxetic structures are formed from a plurality of interconnected segments forming an array of apertures.

FIGS. 1-4, when taken together, illustrate an exemplary article of apparel 10 according to the present disclosure, which in this embodiment is a limb guard comprising a compression sleeve 12 and a protective pad 20 attached to the sleeve 12. The term "article of apparel" as used herein refers to any garment, footwear or accessory configured to be worn on or carried by a human. Examples of articles of apparel include, soft protective headgear (e.g., rugby skull caps), helmets, hats, caps, shirts, pants, shorts, sleeves, knee pads, elbow pads, shoes, boots, backpacks, duffel bags, cinch sacks, and straps, as well as numerous other products configured to be worn on or carried by a person.

Figure 1:
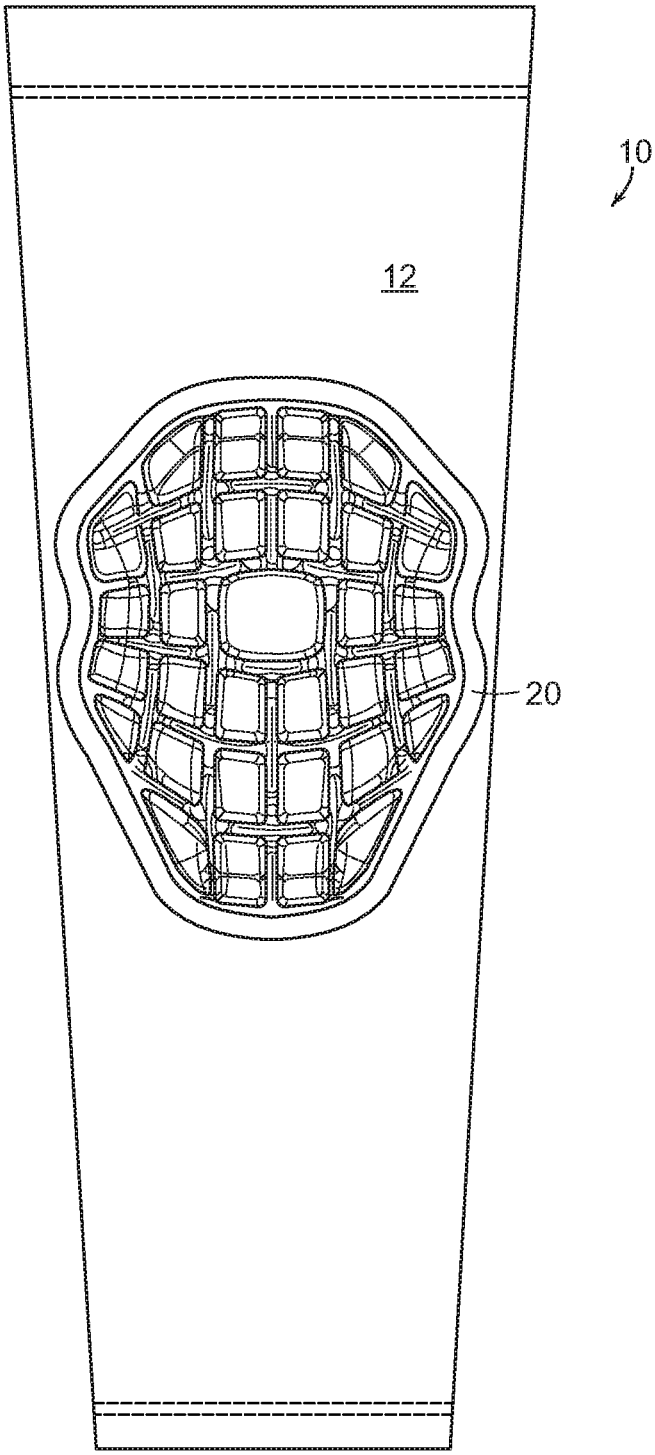
FIG. 1 is a front view of one embodiment of an article of apparel according to the present disclosure.
Figure 2:
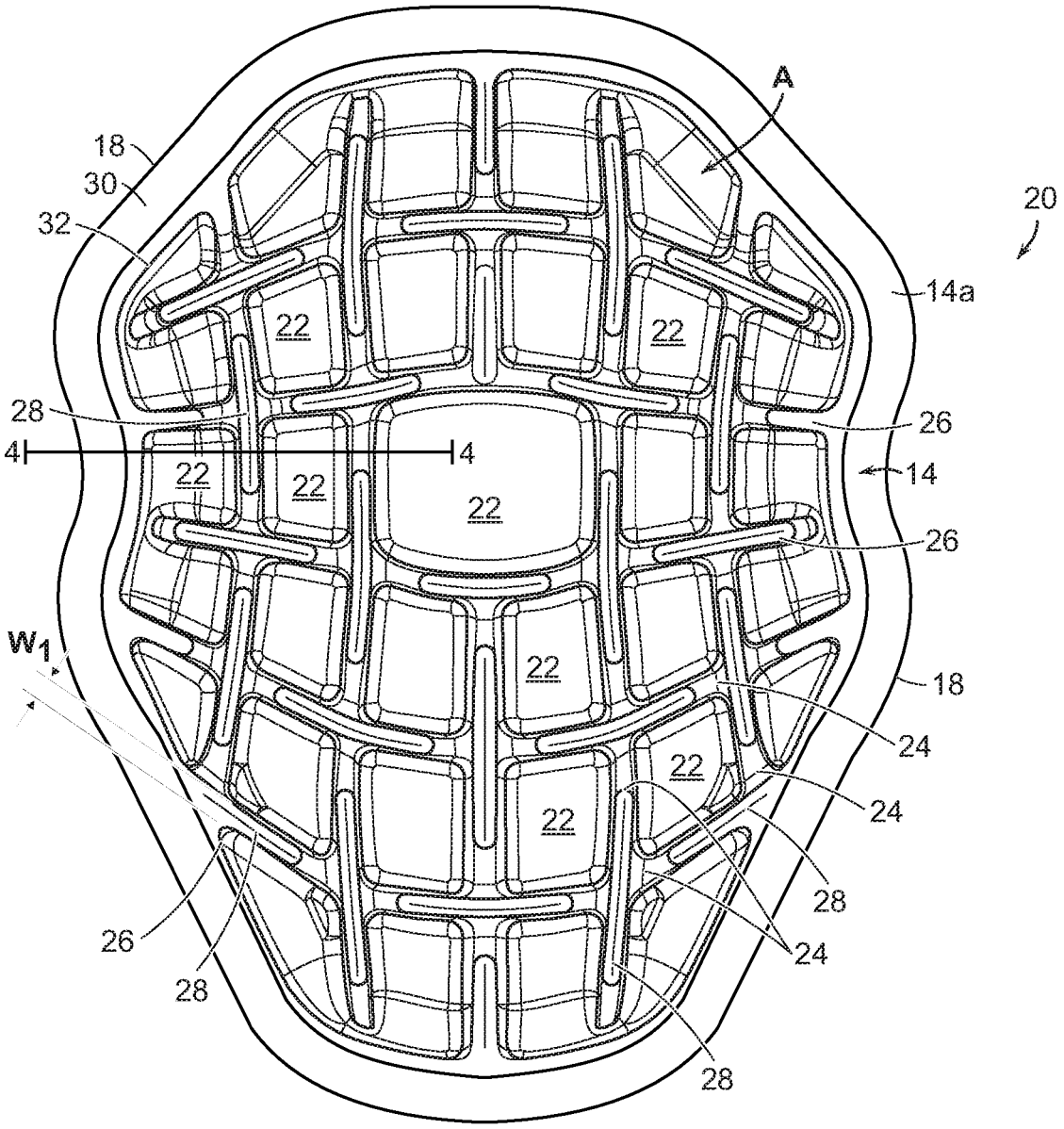
FIG. 2 is a top view of the pad depicted on the article of apparel shown in FIG. 1.
Figure 3:
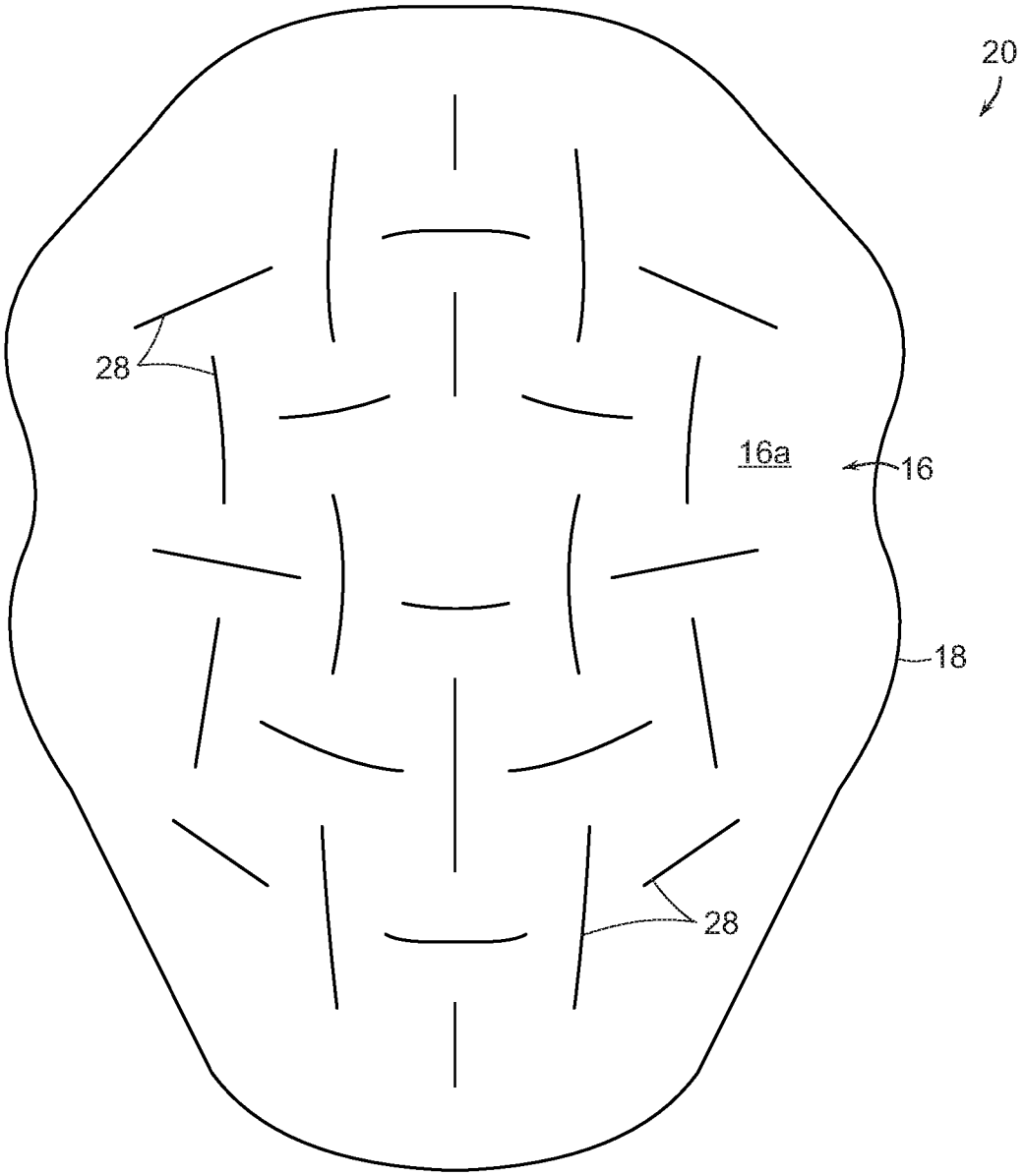
FIG. 3 is a bottom view of the pad shown in FIG. 2.
Figure 4:
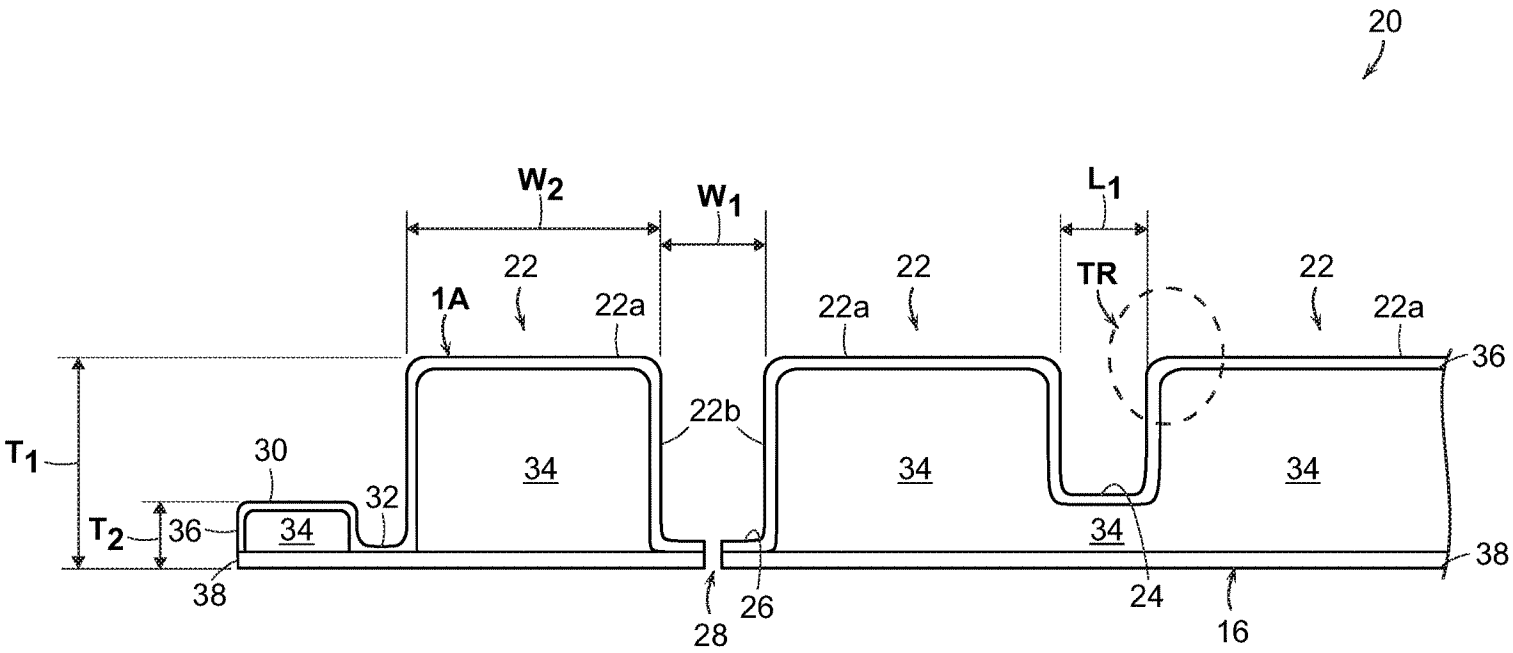
FIG. 4 is a partial cross-section of the pad shown in FIG. 2, through line 4-4 in FIG. 2.

The protective pad 20 is illustrated in more detail in FIGS. 2 and 3. As shown, the pad 20 comprises a front side 14 with a front surface 14 *a*, a back side 16 with a back surface 16 *a*, an edge 18, a perimeter flange 30 and a perimeter channel 32. As shown in FIG. 4, the pad 20 comprises a cushioning material 34 disposed between an outer layer 36 and an inner layer 38. In one non-limiting example, the cushioning material can be PORON® Microcellular Polyurethane from Rogers Corporation, however, any moldable material, such as EVA, can also be used. In another non-limiting embodiment, the inner and outer layers 38, 36 can be TPE—thermoplastic elastomer or TPU—thermoplastic polyurethane. In the present embodiment, the cushioning material 34 is disposed between, and encapsulated by, the outer layer 36 and the inner layer 38. In some embodiments, the cushioning material 34 also may be continuously bonded to both the outer layer 36 and the inner layer 38. The bonding can occur during the molding process and can be the result of a chemical reaction between the TPU and the Poron, when subjected to heat. Thus, it can be a thermal bond, i.e., melting/hardening of the materials. It should be noted that embodiments of the present disclosure can be implemented without one or more of the perimeter flange 30, the perimeter channel 32, the outer layer 36 and the inner layer 38.

The pad 20 includes a repeating pattern of cushioning regions 22 formed in the cushioning material of the pad 20. The cushioning regions 22 will also be referred to hereinafter as "pods 22." In the present embodiment, the pods are rectangular in shape, but it should be understood that a variety of shapes may be used e.g., square, triangular, round, oval, etc. The pods 22 are spaced apart from each other at regular intervals defined, on all sides, by spacer regions 26 having a width "$W_1$". Each of the pods 22 includes an upper surface 22*a* and a sidewall 22*b* extending downwardly from the upper surface 22*a* to the spacer region 26. The number of sidewall 22*b* depends on the shape of the pod 22. Accordingly, a square or rectangular pod 22 has four sidewalls, a round pod has one and a triangular pod has three. Each pod 22 has a thickness "$T_1$" defined by a thickness of the cushioning material 34 and, optionally, a thickness of the inner and outer layers 36, 38, when either or both are included in the pad 20.

In an embodiment implemented without the outer layer 36 and the inner layer 38, the pods 22 comprise the cushioning material 34. In an embodiment implemented with the outer layer 36 and the inner layer 38, then the pods 22 are encapsulated by the outer layer 36 and the inner layer 38.

Although not illustrated as such, if desired, the sidewalls 22*b* may be perpendicular to the upper surface 22*a* or may be disposed at an angle relative to the upper surface 22*a*. If desired, and as shown, the upper surface 22*a* may be radiused at a transition region "TR" between the upper surface 22*a* and the sidewall 22*b*.

A bridge 24 interconnects the sidewalls 22*b* of adjacent pods 22. The bridge 24 functions as a pivot point or hinge about which each pod 22 can rotate when subjected to a force. A length "$L_1$" of each bridge 24 is defined by a distance between the sidewalls 22*b*, which is approximately the same as the width "$W_1$" of the spacer regions 26. Accordingly, each bridge 24 has a thickness of $T_1$ and no aperture 28 and a spacer region 26 has an aperture 28 and essentially no thickness.

In the present embodiment, the bridges 24 are disposed adjacent to each corner of the pods 22, but it should be understood that the location of the bridges 24 between the pods 22 may be varied, and that doing so may increase or decrease the amount of rotation of the pods 22 upon the application of a force to the pad 20. The force applied to the pad 20 is, for example, in an athletic application as a knee guard, be perpendicular to the plane of the pad 20. For example, when wearing a knee guard, bending of the knee would exert pressure on the back of the pad, roughly perpendicular to the backside of the pad.

Referring to FIG. 4, bridges 24 have a length "$L_1$" defined by the spacing between the sidewalls 22*b* of adjacent pods 22 and a thickness "$T_2$" defined by a thickness of the cushioning material 34 (and the inner and outer layers 36, 38, when included). In the present embodiment, the bridge 24 has a thickness $T_2$ less than the thickness $T_1$ of the pods 22 (i.e., $T_2<T_1$). However, it should be understood that the length, width and thickness of the bridges 24 can be varied as desired in order to achieve particular design objectives. As an example of varying design, a square pod with four corners, and referencing the midpoint of each side of the square, with bridges located as close as possible to the corners of the square pods will have a greater expansion threshold than those in which the bridges are located closer to the midpoint of each side of the square.

Providing-the bridges 24 between the pods 22 can be beneficial for several reasons. The bridges 24 limit the expansion of the apertures due to the position of the bridge relative to the sidewall, thereby minimizing tearing or expansion that might otherwise occur if expanded past an expansion threshold, as discussed below. The amount of restriction introduced by the bridges 24 can be varied by varying the dimensions of the bridges 24 and their position between the sidewalls 22*b* of adjacent pods 22. For example, a maximum rotation may be achieved by positioning the bridges 24 adjacent to the corners of the pod 22, whereas minimal or no rotation will occur if the bridges 24 are positioned at a midpoint of the pod sidewall 22*b* as the bridge extends and connects the sidewalls. Similarly, an amount of restriction can be varied by varying the length, width and/or thickness of the bridges 24. For example, rotation about the bridge 24 or pivot point may be maximized by minimizing the length, width and thickness of the bridge 24. Conversely, rotation about the bridge 24 or pivot point may be minimized by maximizing the length, width and/or thickness of the bridge 24. The presence of the bridges 24 may also improve the flow of material during the molding of the pad 20. It should be noted that the pads are cut out of molded sheets. The sheets can be molded from Poron or another material and the pattern of apertures can be die cut into the molded Poron. The sheet can be molded with or without the inner and outer layers.

In use, when a force is applied to the pad 20, the apertures 28 (or vents) expand and the bridges 24 function as pivot points or hinges about which the pods 22 rotate, resulting in the expansion of the pad 20 in both length and width. Upon removal of the force, the apertures 28 contract to their original size, as does the pad 20.

The pods 22, bridges 24, spacer regions 26 and apertures 28 can comprise any shape, size or configuration as is practical or desired for a particular design or application. The size, shape, thickness and material composition of the pads 20, pods 22, bridges 24 and apertures 28 may be varied, depending on a number of factors including, but not limited to, desired amount of expansion of the pad 20, the desired amount of impact resistance, the desired amount of breathability, and the like. In addition, the configuration of the pods 22 may be varied, and more than one type of pod shape or vent shape may be used in the pads 20.

Figure 5:
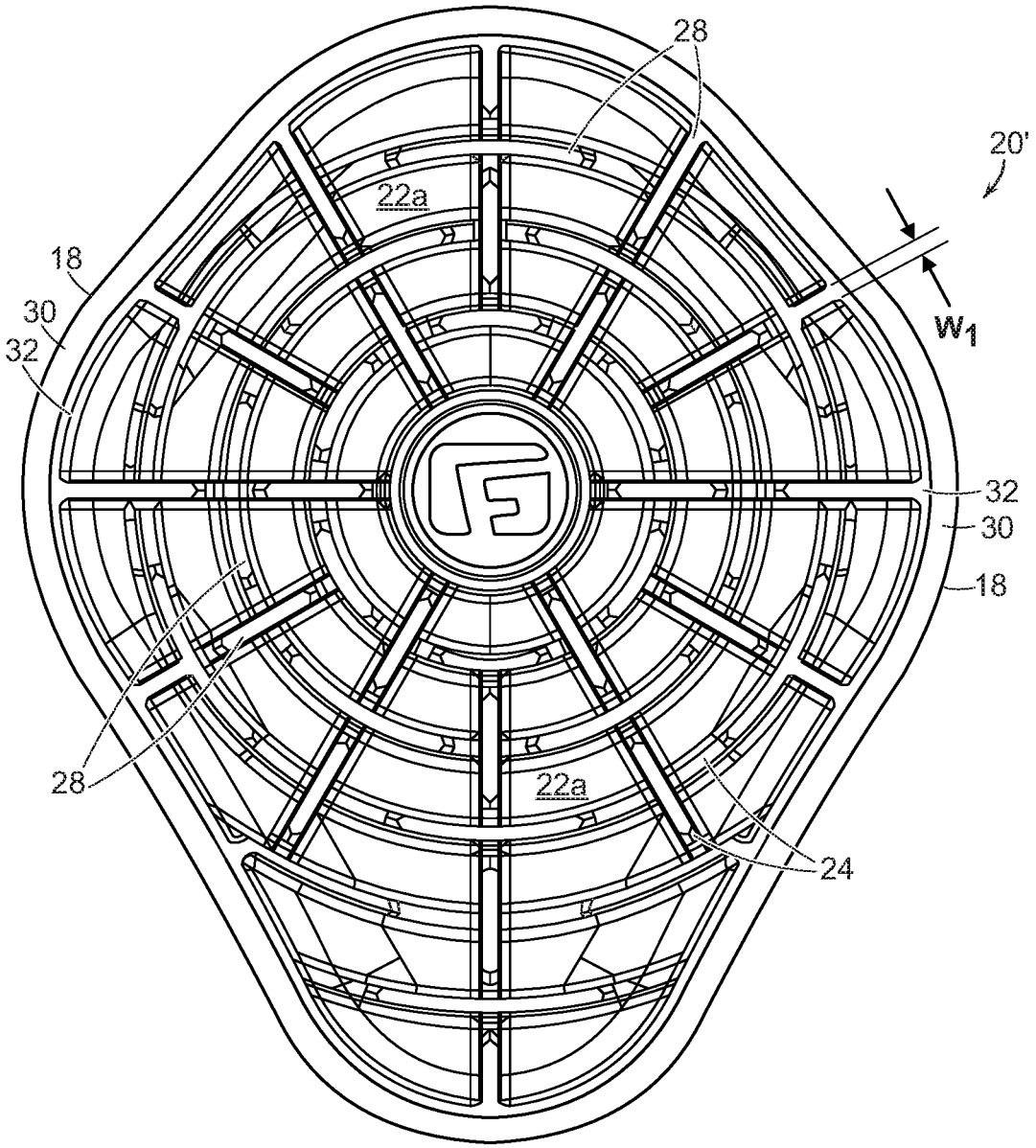
FIG. 5 is a top view of another embodiment of a pad according to the present disclosure.
Figure 6:
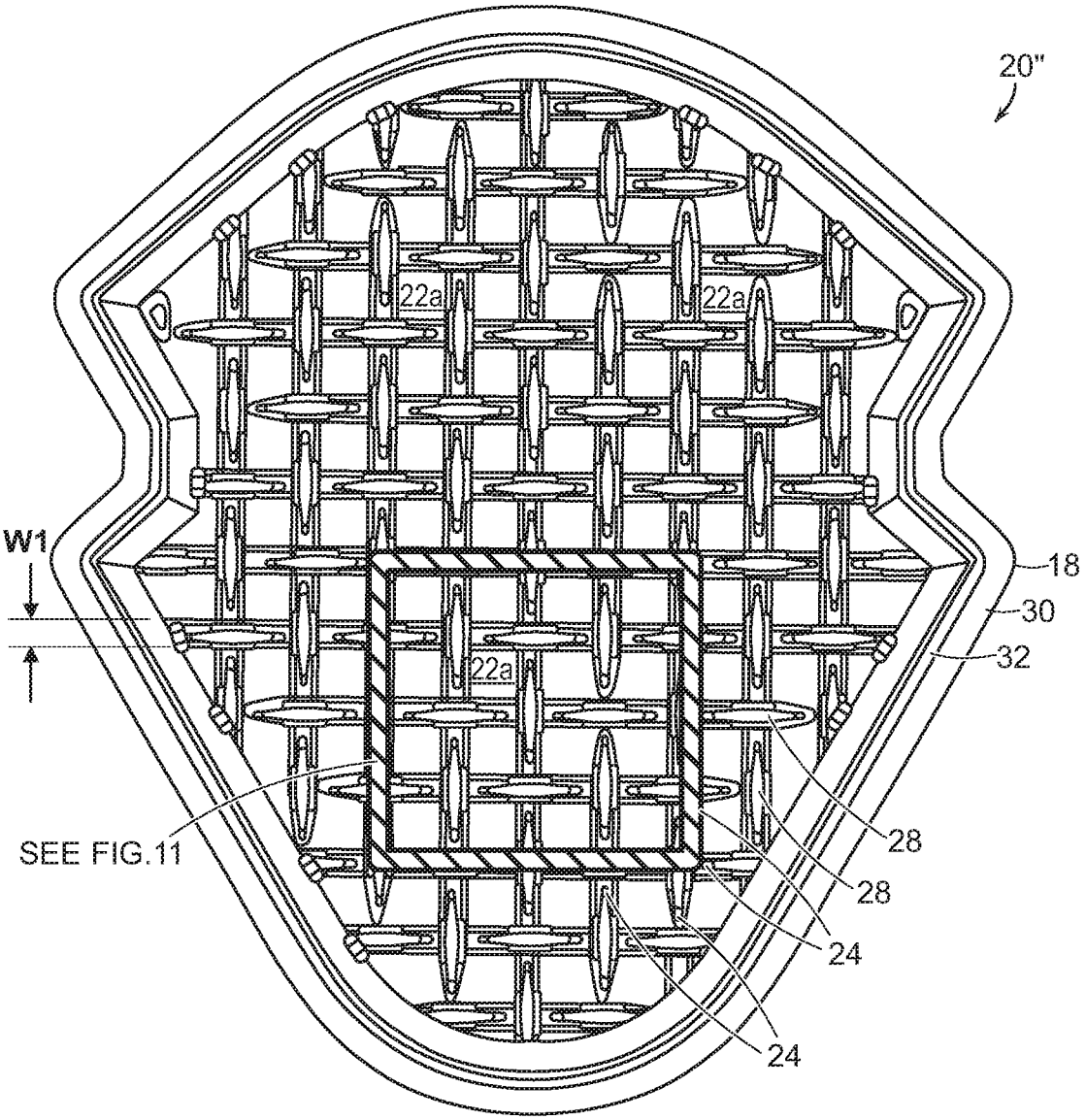
FIG. 6 is a top view of another embodiment of a pad according to the present disclosure.

Referring now to FIG. 5, in accordance with an aspect of the present disclosure, a first alternative embodiment of a pad 20' is presented. A second alternative embodiment of a pad 20", according to the present disclosure, is presented in FIG. 6. Each of the first and second alternative pads 20', 20" includes the same elements as set forth above in the previous embodiments.

Figure 7:
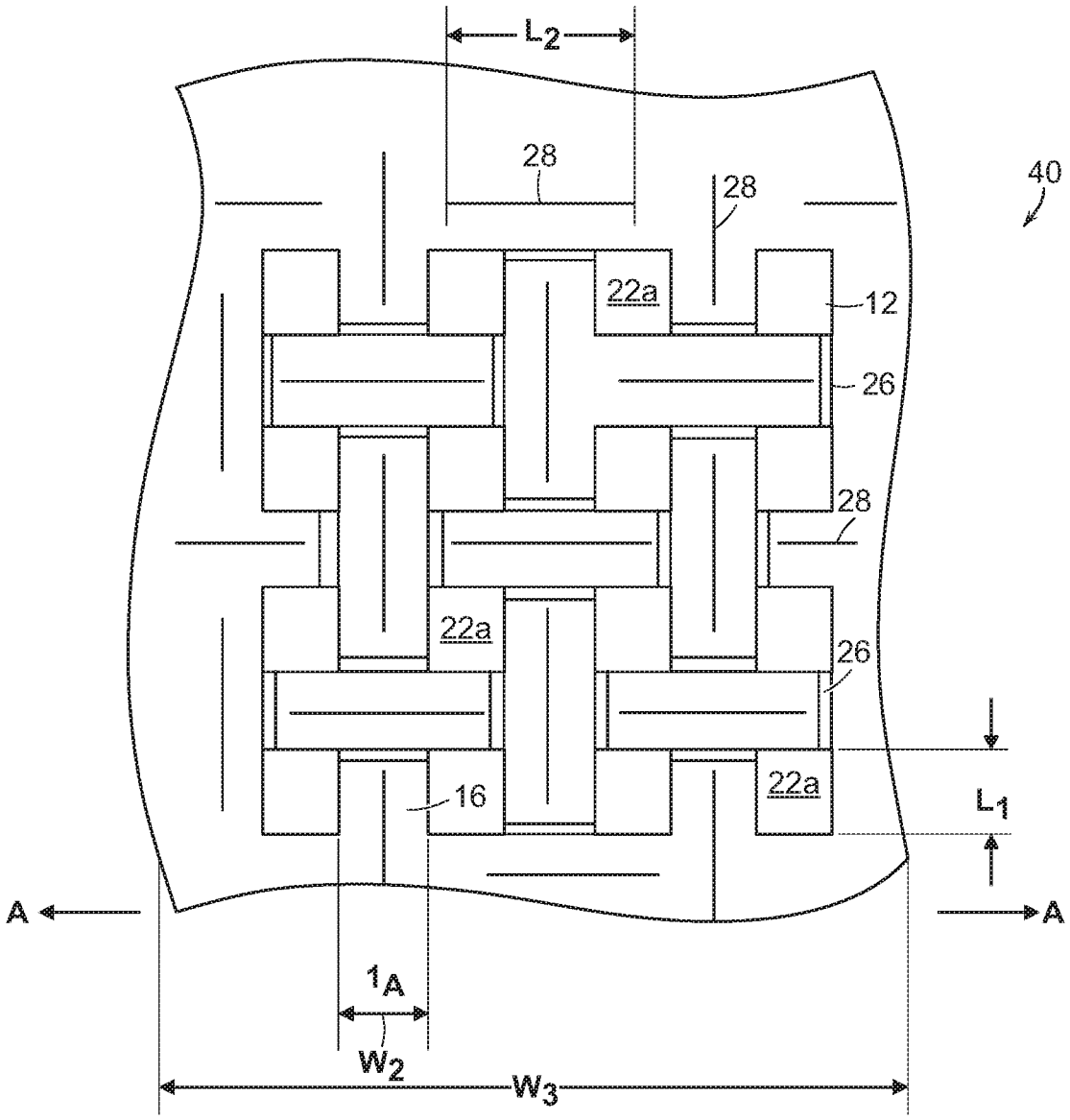
FIG. 7 is a top view of a section of the pad shown in FIG. 6, in an unexpanded state.

FIG. 7 shows a section 40 of the second alternative pad 20" in which each of the pods 22 is molded into the shape of a square having a length "$L_1$" of about 0.5 inch on each side and a thickness $T_1$ of about ⅜ inch. The width $W_1$ of the spacer regions 26 is about ⅛ inch. The plurality of apertures 28 formed in the spacer regions 26 have a length $L_2$ of about ¾ inch and can be formed in the spacer regions during the molding process, for example, or, alternatively, by die cutting apertures through the spacer regions 26 after the molding process. The bridges 24 interconnect adjacent pods 22 and function as pivot points or hinges about which the pods 22 rotate when a force is applied to the section 40, resulting in the expansion of the section 40. FIG. 7 shows section 40 in an unexpanded state, with an unexpanded width of "$W_3$".

Figure 8:
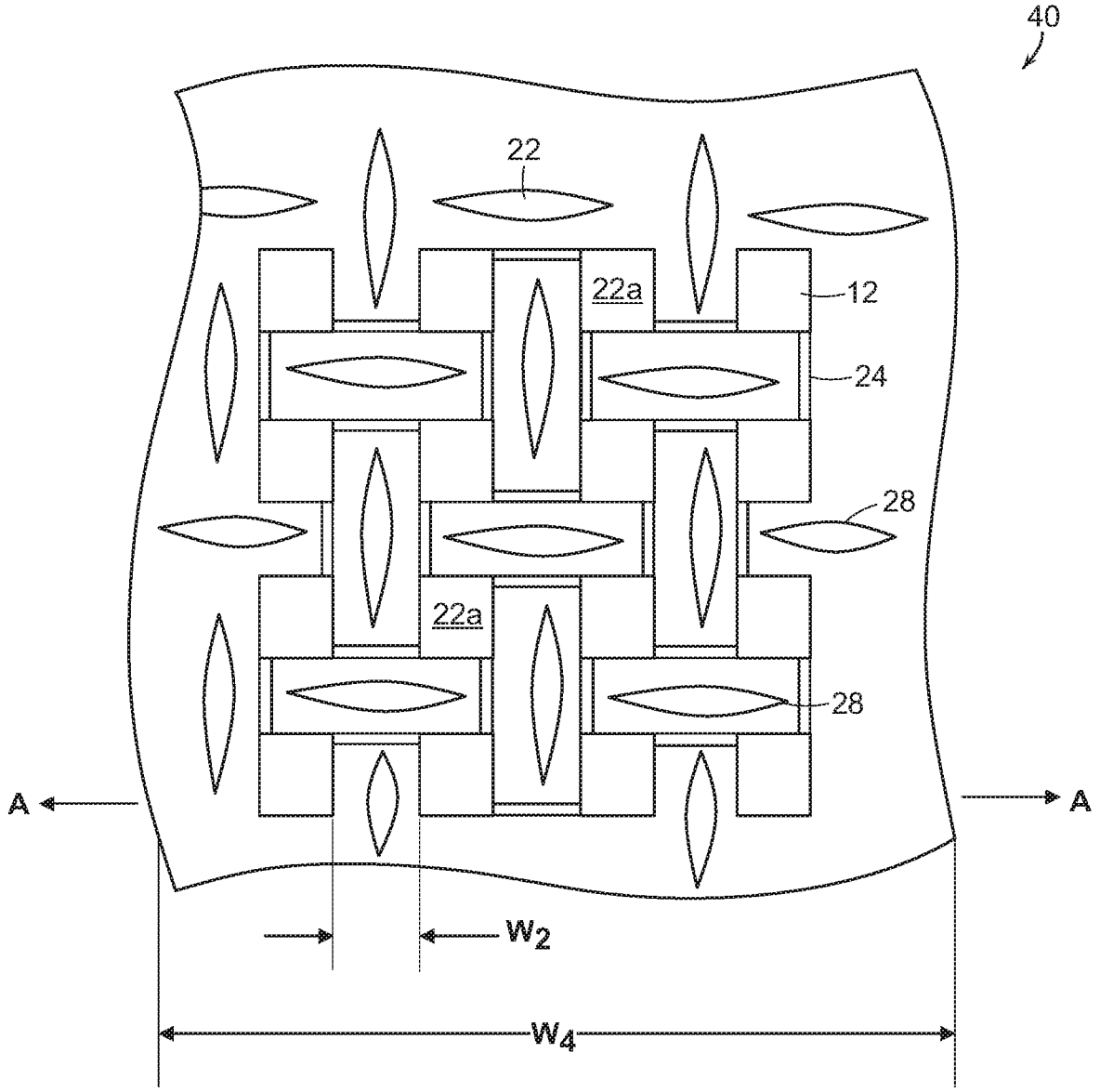
FIG. 8 is a top view of the section shown in FIG. 7, in an expanded state.
Figure 9:
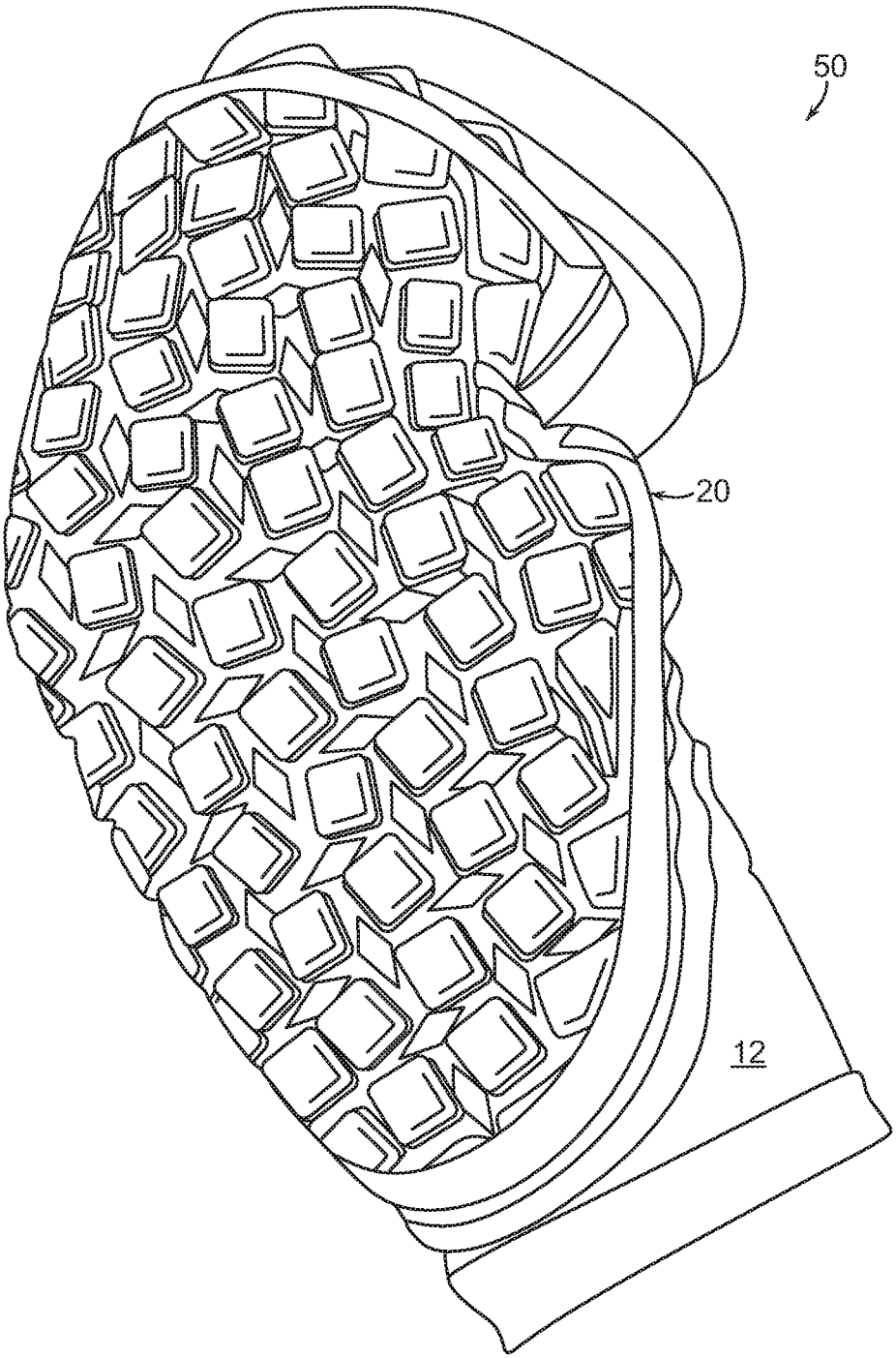
FIG. 9 is a perspective view of the pad shown in FIG. 6, attached to a compression sleeve, with the pad in an expanded state, showing the rotation of the pods.
Figure 10:
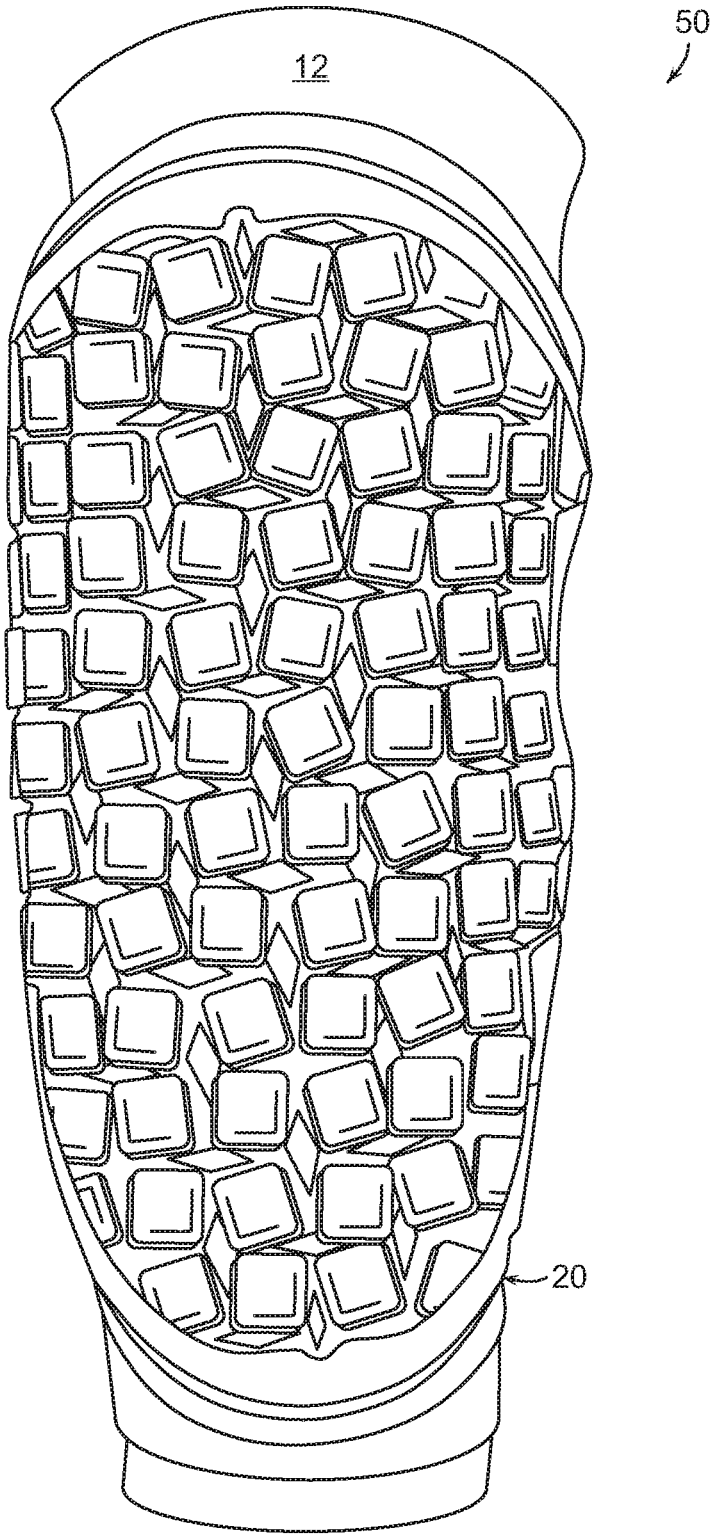
FIG. 10 is a front view of the compression sleeve shown in FIG. 9.

FIG. 8 shows the section 40 in an expanded state with a width of "$W_4$", i.e., expanded in the direction of arrows "A". As can be seen in FIG. 8, when the section 40 is expanded in the direction of arrows A, for example, by stretching, section 40 becomes wider than when in the unexpanded state (i.e., $W_4>W_3$). In use, the bridges 24 function as pivot points or hinges about which the pods 22 rotate, and the rotation of the pods 22 about the bridges 24 facilitates the expansion of the section 40 from a width of $W_2$ to $W_4$.

It will be recognized that whether a structure has a negative Poisson's ratio, may depend upon the degree to which the structure is expanded. Structures may have a negative Poisson's ratio up to a certain expansion threshold, but when expanded past the expansion threshold may have a positive Poisson's ratio. For example, when the section 40 in FIG. 7 is expanded in the direction of arrows A past a threshold (e.g., past the state shown in FIG. 8), the section 40 may be expanded to an extent that the section 40 becomes slightly thinner (in a direction perpendicular to the arrows A) before the structure of the section 40 is torn apart or otherwise damaged. Accordingly, the term "auxetic" as used herein refers to structures or materials that have a negative Poisson's ratio within certain expansion thresholds. Furthermore, while the term "auxetic" is used herein to refer to a structure that has a negative Poisson's ratio, it will be recognized that structures may be "near auxetic." A "near auxetic" structure is a structure having a Poisson's ratio of about zero, or less than 0.15.

Figure 11:
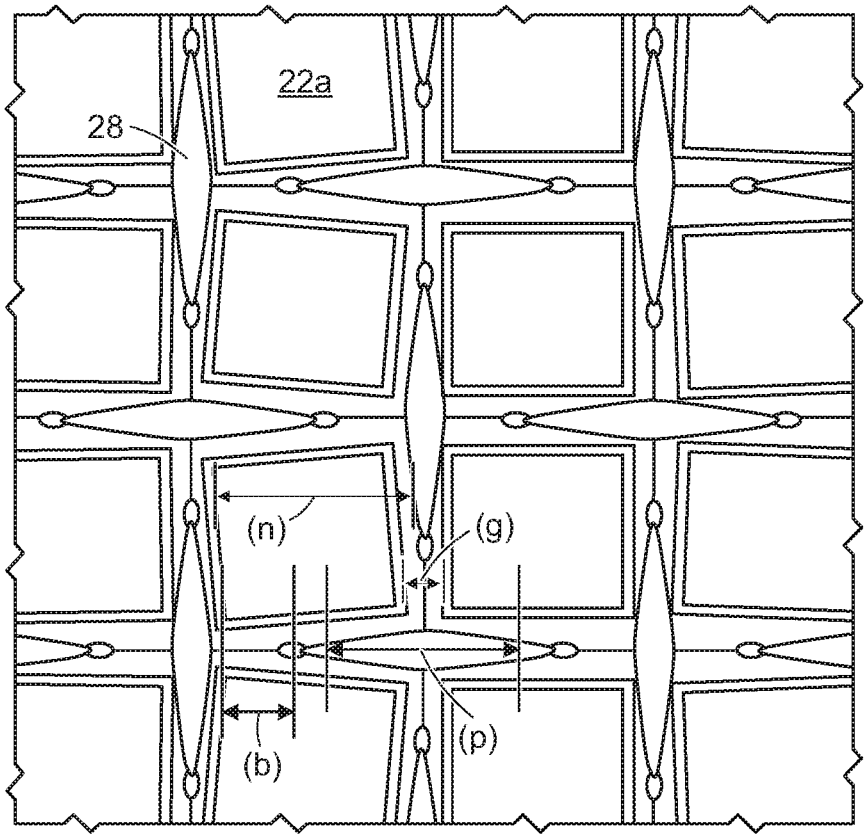
FIG. 11 is a close-up of a portion of a section of the pad shown in FIG. 6.

In one aspect of the present disclosure, referring now to FIG. 11, a relationship between the bridge length (b), the node length (n), the groove width (g) and the aperture length (p) can be defined as follows:

$$b \leq 0.30n; \text{ and}$$

$$p=(2n+g)-2b.$$

For example, for a square pod with a side length of about 0.5 inches and a spacer region width of about 0.2 inches, the maximum bridge length is about 0.15 inch, and the maximum aperture length is about 0.9 inch.

The section 40 described herein may be incorporated into various articles of apparel, including for example, skull caps commonly worn in rugby or under a football helmet. The skull cap is used to provide additional protection for the wearer's head as well as allowing a tight fitting football helmet to slip easily over the head. The negative Poisson's ratio of the structure described herein allows the skull cap and foam to fit a large number of different head sizes. Additional protection for the head is provided by the auxetic section to protect the head from impacts commonly experienced during training or competition. Also, section 40 may be provided over the entire skull cap, or only over a portion of the skull cap.

The present pads may be manufactured using techniques disclosed in U.S. Pat. Nos. 7,827,704 and 9,254,591 and U.S. Publication US2008/0034614, which are incorporated herein by reference in their entirety.

It should be noted that the terms "first," "second," and the like herein do not denote any order or importance, but rather are used to distinguish one element from another, and the terms "a" and "an" herein do not denote a limitation of quantity, but rather denote the presence of at least one of the referenced items. Similarly, it is noted that the terms "bottom" and "top" are used herein, unless otherwise noted, merely for convenience of description, and are not limited to any one position or spatial orientation. In addition, the modifier "about" used in connection with a quantity is inclusive of the stated value and has the meaning dictated by the context (e.g., includes the degree of error associated with measurement of the particular quantity). Unless defined otherwise, technical and scientific terms used herein have the same meaning as is commonly understood by one of skill in the art to which this disclosure belongs.

While the disclosure has been described with reference to exemplary embodiments, it will be understood by those skilled in the art that various changes may be made, and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A padding section, comprising:

an upper layer, an opposing lower layer and a repeating array of cushioning regions disposed between, and continuously bonded to, the upper layer and the lower layer, each cushioning region having a cushion length (n) and comprising cushioning material having a same first cushion thickness, the cushioning regions being separated by spacer regions of width (g);

a plurality of cushioning bridges each extending between and interconnecting sidewalls of adjacent cushioning regions while serving as a pivot point between the cushioning regions, each cushioning bridge having a bridge thickness, a bridge width and a bridge length (b); and a repeating array of apertures having a length (p) and disposed between interconnected sidewalls of adjacent cushioning regions and extending through the padding section, wherein: the padding section has a first thickness and a first width and wherein upon application of a force, the padding section expands from the first width to a second width greater than the first width and when the application of force is removed, the padding section contracts to the first width;

the bridge lengths (b), the cushion length (n), the spacer region width (g), and the aperture length (p) create an auxetic structure in the padding section; and the bridge length (b), the cushion length (n), the spacer region width (g), and the aperture length (p) are defined as follows:

$$b \leq 0.30n; \text{ and}$$

$$p = (2n+g) - 2b.$$

2. The padding section of claim 1, wherein the cushioning bridge thickness is less than a cushion thickness of the cushioning regions.

3. The padding section of claim 1, wherein the bridge length is no more than ⅓ of the cushion length of the cushioning region.

4. The padding section of claim 1, wherein the spacer regions are defined by the cushioning regions and the cushioning bridges.

5. The padding section of claim 4, wherein the upper layer and the lower layer are at least partially bonded directly together in each spacer region.

6. The padding section of claim 1, wherein the cushioning bridges are disposed in the spacer regions.

7. The padding section of claim 1, wherein the repeating array of apertures is disposed in the spacer regions and wherein one aperture is disposed in each spacer region.

8. The padding section of claim 1, wherein the padding section expands in width by 20% to 30% when subjected to the force.

9. The padding section of claim 1, further comprising a perimeter flange extending around the padding section.

10. The padding section of claim 7, wherein when the padding section is subjected to the force, the cushioning regions pivot about the cushioning bridges and the apertures expand from a first size to a second size and when the force is removed, the apertures contract from the second size to the first size.

11. The padding section of claim 1, wherein at least two of the cushioning regions are connected by cushioning material.

12. A protective pad, comprising:

a substrate of cushioning material having a first surface and an opposed second surface with an upper layer of material bonded to the first surface of the substrate and a lower layer of material bonded to the second surface of the substrate;

a plurality of discrete spaced apart cushioning regions provided in the substrate, the cushioning regions being spaced apart by spacer regions of width (g), each cushioning region having a same first cushion thickness and a cushion length (n);

a first plurality of linear substrate apertures, each aperture disposed between interconnected sidewalls of adjacent cushioning regions in a first plurality of cushioning regions, each aperture extending through the cushioning material and the upper and lower layers of material and each aperture of the first plurality aligned with a first axis of the substrate;

a second plurality of linear substrate apertures, each aperture disposed between adjacent cushioning regions in a second plurality of cushioning regions, each aperture extending through the cushioning material and the upper and lower layers of material and each aperture of the second plurality aligned with a second axis of the substrate different than the first axis, wherein the first plurality of linear substrate apertures and the second plurality of substrate apertures have an aperture length (p); and a plurality of cushioning bridges each extending between and interconnecting sidewalls of adjacent cushioning regions while serving as a pivot point between the cushioning regions, each cushioning bridge having a bridge thickness, a bridge width and a bridge length (b), wherein the bridge lengths (b), the cushion length (n), the spacer region width (g), and the aperture length (p) create an auxetic structure in the protective pad, wherein the bridge length (b), the cushion length (n), the spacer region width (g), and the aperture length (p) are defined as follows:

$b \leq 0.30n$; and $p = (2n+g) - 2b$.

* * * * *